US008052470B1

(12) United States Patent
Lin

(10) Patent No.: US 8,052,470 B1
(45) Date of Patent: Nov. 8, 2011

(54) PROBE CONNECTOR

(75) Inventor: Jui-Pin Lin, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/004,900

(22) Filed: Jan. 12, 2011

(51) Int. Cl.
*H01R 13/648* (2006.01)

(52) U.S. Cl. ..... 439/607.01; 439/607.58

(58) Field of Classification Search ..... 439/607.58, 439/607.01, 824, 857, 700, 482
See application file for complete search history.

(56) References Cited

U.S. PATENT DOCUMENTS 2,774,052 A * 12/1956 Flour ..... 361/744
7,662,000 B2 * 2/2010 Hou et al. ..... 439/824
7,740,508 B2 * 6/2010 Feldman et al. ..... 439/700
7,815,474 B1 * 10/2010 Lin et al. ..... 439/700
2004/0043653 A1 * 3/2004 Feldman ..... 439/219
2004/0115994 A1 * 6/2004 Wulff et al. ..... 439/700

* cited by examiner

*Primary Examiner* — Briggitte R Hammond

(57) ABSTRACT

A probe connector includes an insulating housing, a plurality of probe pins and a shielding shell. The insulating housing has a base body. A front of the base body protrudes frontward to form a tongue portion. The insulating housing defines a plurality of inserting holes each longitudinally penetrating through the base body and the tongue portion. The probe pins are inserted in the corresponding inserting holes. The shielding shell encloses the tongue portion. The shielding shell has a front plate and a hollow blocking plate extending rearward from a periphery edge of the front plate and having an accommodating chamber formed therein. The front plate defines a plurality of matching holes. The tongue portion of the insulating housing is inserted in the accommodating chamber and a front side thereof abuts against the front plate to make the matching holes aligned with the corresponding inserting holes.

8 Claims, 3 Drawing Sheets

PROBE CONNECTOR

BACKGROUND OF THE INVENTION

1. Field of the Invention

The present invention relates to a probe connector, and more particularly to a probe connector capable of preventing electromagnetic interference effectively.

2. The Related Art

A traditional probe connector generally includes an insulating housing and a plurality of probe pins. The insulating housing has a base body and a tongue portion protruded frontward from a middle of a front of the base body. The insulating housing defines a plurality of inserting holes longitudinally penetrating through the base body and the tongue portion. The probe pins are inserted in the inserting holes of the insulating housing.

However, the probe connector described above has no shielding structure. As a result, an electromagnetic interference is apt to happen among the probe pins, and more particularly a high-frequency electromagnetic interference is apt to happen between the probe pins and other electronic components.

SUMMARY OF THE INVENTION

An object of the present invention is to provide a probe connector with a dielectric body being mounted thereon. The probe connector includes an insulating housing, a plurality of probe pins and a shielding shell. The insulating housing has a base body. A front of the base body protrudes frontward to form a tongue portion. The insulating housing defines a plurality of inserting holes each longitudinally penetrating through the base body and the tongue portion. The probe pins are inserted in the corresponding inserting holes of the insulating housing. The shielding shell encloses the tongue portion of the insulating housing. The shielding shell has a front plate and a hollow blocking plate extending rearward from a periphery edge of the front plate and having an accommodating chamber formed therein. The front plate defines a plurality of matching holes arranged in accordance with the inserting holes of the insulating housing and communicating with the accommodating chamber. The tongue portion of the insulating housing is inserted in the accommodating chamber of the shielding shell and a front side thereof abuts against the front plate of the shielding shell to make the matching holes aligned with the corresponding inserting holes.

As described above, the tongue portion of the probe connector is inserted in the accommodating chamber of the shielding shell, and the front side of the tongue portion abuts against an inside of the front plate to make the matching holes aligned with the corresponding inserting holes, to effectively avoid electromagnetic interference and more particularly high-frequency signal transmitting electromagnetic interference happening among the probe pins and other electronic components, so that electrical signals can be transmitted effectively.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
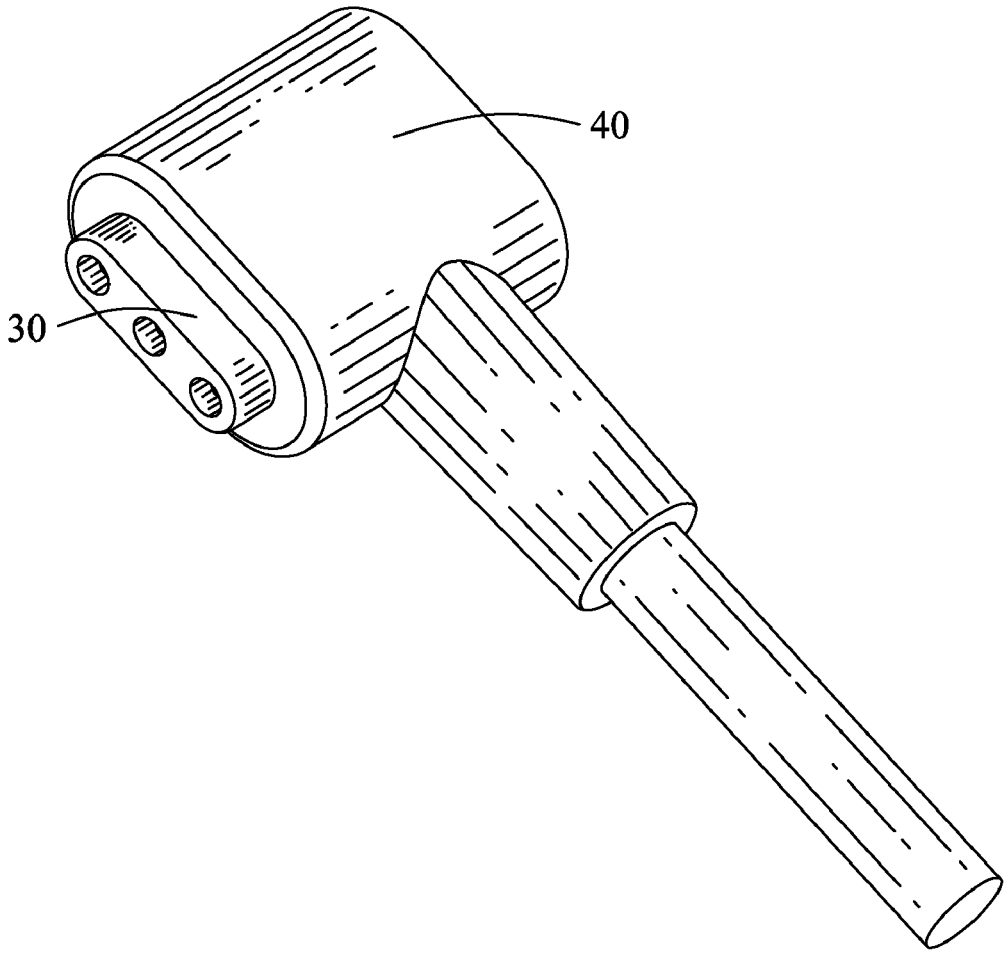
FIG. 1 is an assembled perspective view of a probe connector according to the present invention, wherein a dielectric body is mounted around the probe connector.
Figure 2:
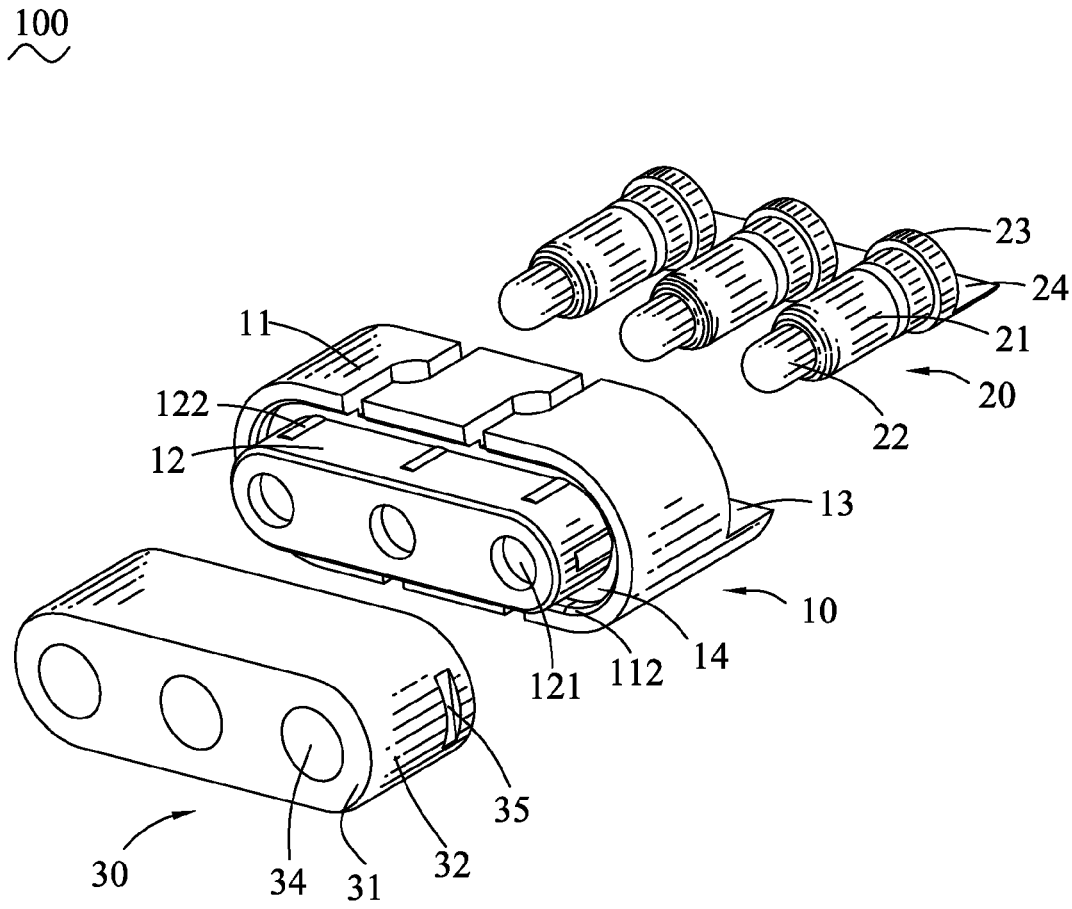
FIG. 2 is an exploded perspective view of the probe connector of FIG. 1.

With reference to FIG. 1 and FIG. 2, a probe connector 100 according to the present invention with a dielectric body 40 being mounted thereon includes an insulating housing 10, a plurality of probe pins 20 and a shielding shell 30 mounted to the insulating housing 10 respectively.

Figure 3:
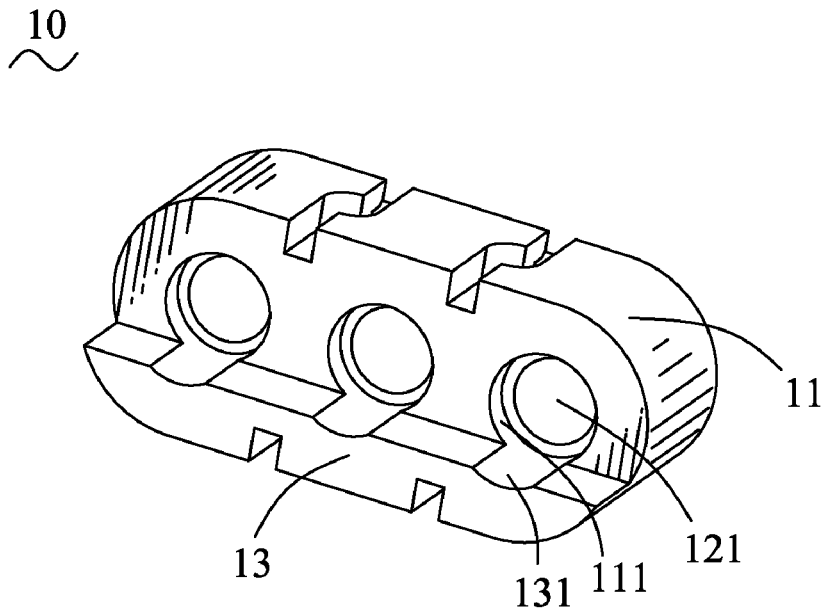
FIG. 3 is a perspective view of an insulating housing of the probe connector of FIG. 2.

Referring to FIGS. 2-3, the insulating housing 10 has a base body 11 of elliptical shape viewed from a front view, and a tongue portion 12 protruded frontward from a middle of a front of the base body 11. The insulating housing 10 defines a plurality of inserting holes 121 each longitudinally penetrating through the base body 11 and the tongue portion 12. A rear end of each of the inserting holes 121 is further spread outward to form a blocking groove 111. A lower portion of a rear of the base body 11 extends rearward to form a propping portion 13 adjacent to bottoms of the blocking grooves 111. The bottom of the blocking groove 111 further extends rearward to pass through a top of the propping portion 13 to define a soldering groove 131. A periphery edge of the front of the base body 11 protrudes frontward with a short distance to form a ring-shaped flange 112 spaced from an outer periphery of the tongue portion 12 to define an inserting space 14 between the flange 112 and the tongue portion 12. A plurality of resisting strips 122 are protruded outward from an outer periphery of the tongue portion 12 and each extends along the extension direction of the tongue portion 12.

Referring to FIG. 2, the probe pin 20 has a barrel 21, a plunger 22 movably inserted in the barrel 21 and further projecting out of a front end of the barrel 21, a blocking portion 23 extended rearward from a rear end of the barrel 21 and having a greater diameter than that of the barrel 21, and a soldering plate 24 extended rearward from a bottom of a rear end of the blocking portion 23.

Figure 4:
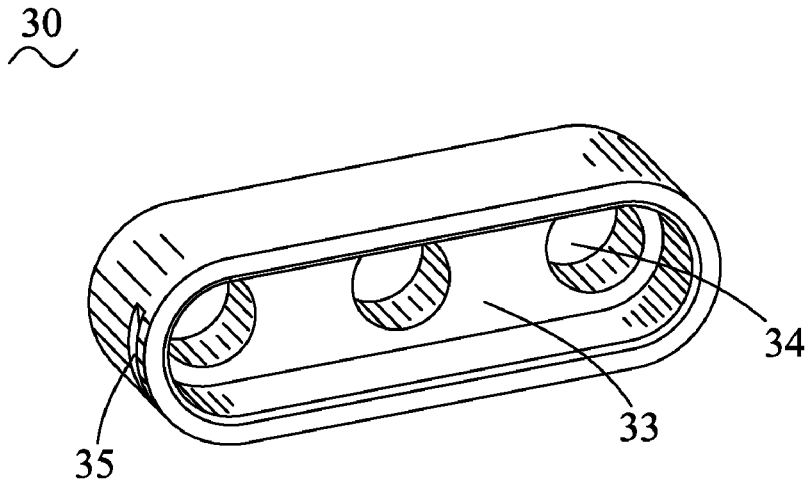
FIG. 4 is a perspective view of a shielding shell of the probe connector of FIG. 2.

Referring to FIG. 2 and FIG. 4, the shielding shell 30 is made of metal plate, and has an elliptical front plate 31. A periphery edge of the front plate 31 extends rearward to form a hollow elliptical blocking plate 32 with an accommodating chamber 33 formed therein. The front plate 31 defines a plurality of matching holes 34 arranged in accordance with the inserting holes 121 of the insulating housing 10 and communicating with the accommodating chamber 33. Two rears of two opposite sides of the blocking plate 32 define two fillisters 35 vertically extending, respectively.

Referring to FIGS. 1-4, when assembling the probe connector 100, the probe pins 20 are inserted forward into the inserting holes 121 of the insulating housing 10 and the blocking portions 23 are buckled in the blocking grooves 111. The soldering plates 24 are received in the soldering grooves 131 for being soldered on a printed circuit board (not shown). The tongue portion 12 of the insulating housing 10 is inserted in the accommodating chamber 33 of the shielding shell 30 to make the shielding shell 30 enclose the tongue portion 12 of the insulating housing 10. A rear end of the blocking plate 32 of the shielding shell 30 is inserted in the inserting space 14. A front side of the tongue portion 12 abuts against an inside of the front plate 31 to make the matching holes 34 aligned with the corresponding inserting holes 121. The resisting strips 122 are against an inner periphery of the blocking plate 32 to secure the shielding shell 30 with the tongue portion 12.

Then injection mold the dielectric body 40 to outsides of the probe connector 100, with fronts of the tongue portion 12 of the insulating housing 10 and the shielding shell 30 being exposed outward. The fillisters 35 can accumulate melting material therein to make the dielectric body 40 firmly integrated with the probe connector 100, when injection molding the dielectric body 40 on the outsides of the probe connector 100.

As described above, the tongue portion 12 of the probe connector 100 in according to the present invention is inserted in the accommodating chamber 33 of the shielding shell 30, the front side of the tongue portion 12 abuts against the inside of the front plate 31 to make the matching holes 34 aligned with the corresponding inserting holes 121, and a rear end of the blocking plate 32 is inserted in the inserting space 14 to effectively avoid electromagnetic interference and more particularly high-frequency signal transmitting electromagnetic interference happening among the probe pins and other electronic components, so that electrical signals can be transmitted effectively.

What is claimed is:

1. A probe connector with a dielectric body being enclosed therearound, comprising:

an insulating housing having a base body, a front of the base body protruding frontward to form a tongue portion, the insulating housing defining a plurality of inserting holes each longitudinally penetrating through the base body and the tongue portion;

a plurality of probe pins inserted in the corresponding inserting holes of the insulating housing; and a shielding shell enclosing the tongue portion of the insulating housing, the shielding shell having a front plate and a hollow blocking plate extending rearward from a periphery edge of the front plate and having an accommodating chamber formed therein, the front plate defining a plurality of matching holes arranged in accordance with the inserting holes of the insulating housing and communicating with the accommodating chamber, the tongue portion of the insulating housing being inserted in the accommodating chamber of the shielding shell and a front side thereof abutting against the front plate of the shielding shell to make the matching holes aligned with the corresponding inserting holes.

2. The probe connector as claimed in claim 1, wherein a periphery edge of the front of the base body protrudes frontward to form a ring-shaped flange spaced from an outer periphery of the tongue portion to define an inserting space between the flange and the tongue portion, a rear end of the shielding shell is inserted in the inserting space.

3. The probe connector as claimed in claim 1, wherein an outer periphery of the tongue portion protrudes outward to form a plurality of resisting strips against an inner periphery of the blocking plate.

4. The probe connector as claimed in claim 3, wherein each of the resisting strips extends along the extension direction of the tongue portion of the insulating housing.

5. The probe connector as claimed in claim 1, wherein the probe pin includes a barrel and a plunger movably inserted in the barrel and further projecting out of a front end of the barrel, a rear end of the barrel extends rearward to form a blocking portion having a greater diameter than that of the barrel, a rear end of each of the inserting holes is further spread outward to form a blocking groove for buckling the blocking portion therein.

6. The probe connector as claimed in claim 5, wherein a lower portion of a rear of the base body extends rearward to form a propping portion adjacent to bottoms of the blocking grooves for propping up the soldering plate.

7. The probe connector as claimed in claim 6, wherein the bottom of each blocking groove further extends rearward to pass through a top of the propping portion and define a soldering groove for receiving the corresponding soldering plate therein.

8. The probe connector as claimed in claim 1, wherein two opposite sides of the blocking plate of the shielding shell define two fillisters for making the probe connector integrated with the dielectric body firmly.

* * * * *